US008857944B2

(12) United States Patent
Yamamoto et al.

(10) Patent No.: US 8,857,944 B2
(45) Date of Patent: Oct. 14, 2014

(54) METHOD FOR CONTROLLING TRANSPORTATION OF PRINT MEDIUM IN INKJET PRINTING APPARATUS AND THE INKJET PRINTING APPARATUS

(71) Applicant: Dainippon Screen Mfg. Co., Ltd., Kyoto (JP)

(72) Inventors: Takaharu Yamamoto, Kyoto (JP); Shoji Kakimoto, Kyoto (JP)

(73) Assignee: Dainippon Screen Mfg. Co., Ltd., Kyoto-Shi, Kyoto (JP)

( * ) Notice: Subject to any disclaimer, the term of this patent is extended or adjusted under 35 U.S.C. 154(b) by 14 days.

(21) Appl. No.: 13/852,851

(22) Filed: Mar. 28, 2013

(65) Prior Publication Data

US 2013/0257963 A1 Oct. 3, 2013

(30) Foreign Application Priority Data

Mar. 28, 2012 (JP) ..... 2012-074542

(51) Int. Cl.
*B41J 13/00* (2006.01)

(52) U.S. Cl.
CPC ..... *B14J 13/0009* (2013.01)
USPC ..... 347/16

(58) Field of Classification Search
CPC .... B41J 13/0009; B41J 11/0095; B41J 29/38; B41J 15/04; B41J 11/007; B41J 13/0027; B41J 11/42; B41J 13/0036; B41J 15/165; B41J 3/60; B41J 29/393
See application file for complete search history.

(56) References Cited

U.S. PATENT DOCUMENTS

2010/0053251 A1* 3/2010 Igarashi et al. ..... 347/16

FOREIGN PATENT DOCUMENTS

JP 07-196216 A 8/1995
JP 2000-262091 A 9/2000

* cited by examiner

*Primary Examiner* — Lisa M Solomon
(74) *Attorney, Agent, or Firm* — McDermott Will & Emery LLP

(57) ABSTRACT

Web paper is transported by roll with two or more drive rollers. The two adjacent drive rollers each have difference in rotation speed in accordance with a draw ratio. Accordingly, tension is applied to the web paper. Tension of the web paper between the adjacent drive rollers is detected by a tension sensor. A tension controller controls the detected tension value so as to be a target tension value. A predictive control device predicts decrease in tension during an initial printing period where tension control is not stable, and increases rotation speeds of the drive rollers downstream of a print unit to suppress the decrease in tension. Consequently, tension acting on the web paper is appropriately controlled also during the initial printing period, resulting in possible reduction in printing quality.

18 Claims, 7 Drawing Sheets

METHOD FOR CONTROLLING TRANSPORTATION OF PRINT MEDIUM IN INKJET PRINTING APPARATUS AND THE INKJET PRINTING APPARATUS

RELATED APPLICATIONS

This application claims the benefit of Japanese Application No. 2012-074542, filed on Mar. 28, 2012, the disclosures of which Application is incorporated by reference herein.

BACKGROUND OF THE INVENTION

1. Field of the Invention

This invention relates to a method for controlling transportation of a print medium, such as paper and a film, to be printed in an inkjet printing apparatus, and relates to the printing apparatus using the method. More particularly, this invention is directed to a technique of controlling tension acting on the print medium transported by roll.

2. Description of the Related Art

The following has been conventionally known as an inkjet printing apparatus. That is, the inkjet printing apparatus feeds out a print medium wound in a roll form, such as web paper, and transports by roll the web paper. The inkjet printing apparatus then performs printing on the web paper with an inkjet print unit provided above a transportation path of the web paper. Thereafter, the inkjet printing apparatus dries ink adhering to the web paper with a drying section provided downstream of the printing unit. The inkjet printing apparatus finally winds the web paper in a roll form and collects the web paper.

In such the inkjet printing apparatus, uniform tension is applied to the web paper to be transported by roll. Examples of approaches for applying tension to the web paper to be transported by roll include draw control. In the draw control, each speed ratio between two adjacent drive rollers among two or more drive rollers is set in advance. The drive rollers are disposed along a transportation path for transporting the web paper. See, for example, Japanese Patent Publication No. 2000-262091. The draw control causes a difference in speed between the two adjacent drive rollers for transporting the web paper (i.e., a rotational speed of the drive roller downstream is greater than that of the drive roller upstream), resulting in application of tension to the web paper.

As the tension acting on the web paper to be transported varies, so-called shift register occurs. Accordingly, printing quality decreases. Thus a tension control method is adopted. In the method, tension of the web paper during transportation is detected, and speeds of drive rollers are operated such that the tension has a uniform value. See, for example, Japanese Patent Publication No. H07-196216.

However, the conventional examples with such constructions have the following drawback.

That is, when ink adheres to the web paper in the print unit, the web paper expands due to ink penetrated in the web paper. Such phenomenon may occur. Tension decreases as the web paper expands. Decrease of the tension is detected by a tension detecting sensor. Then, the rotation speeds of the drive rollers are controlled such that the detected tension has a given targeted value. Such a feedback control finally enables the tension to be maintained at a preferable value. On the other hand, a considerable time delay occurs from when the ink firstly adheres to the web paper to cause expansion of the web paper until when the feedback control leads to the tension maintained at a given value. As noted above, the tension acting on the web paper decreases during an initial printing period, resulting in decreased printing quality. Such a drawback may arise.

SUMMARY OF THE INVENTION

Additional features of the invention will be set forth in the description which follows, and in part will be apparent from the description, or may be learned by practice of the invention.

This invention has been made regarding the state of the art noted above, and its object is to provide a method for controlling transportation of a print medium in an inkjet printing apparatus and the inkjet printing apparatus. The method enables to prevent reduction in printing quality possibly by appropriately controlling tension acting on the print medium also during an initial printing period.

This invention is constituted as stated below to achieve the above object. This invention discloses a method for transporting a print medium in an inkjet printing apparatus. In the method, the print medium wound in a roll form is fed out. The print medium is transported by roll with two or more drive rollers disposed along a transportation path of the print medium. The print medium is printed with an inkjet print unit disposed above the transportation path. Ink adhering to the print medium is dried by a drying section disposed downstream of the print unit. The print medium is finally wounded and collected in a roll form. The method includes a tension-generating step of generating tension on the print medium in accordance with a difference in speed between the two adjacent drive rollers; a tension-detecting step of detecting tension acting on the print medium between the two adjacent drive rollers; a controlling step of controlling rotation speeds of the drive rollers such that the detected value of tension has a target value of tension; and a predictive control step of predicting decrease in tension due to expansion of the print medium during an initial period of starting printing on the print medium until the control step causes the stable detected value of tension, and increasing the rotation speeds of the drive rollers downstream of the print unit to suppress decrease in tension of the print medium.

In the example of this invention, tension acts on the print medium in accordance with the difference in speed between the two adjacent drive rollers in a steady state where the print medium is printed. When ink adheres to the web paper, the web paper expands due to ink penetrated in the web paper, resulting in decreased tension. When decreased tension of the print medium is detected, the rotation speed of the drive roller is controlled such that the decreased tension has a target value of tension. As a result, the tension of the print medium is maintained at the targeted value of tension in the steady state. On the other hand, a certain time (a delay time) is needed during the initial period of starting printing to the print medium until the detected value of tension is stable in the control step. That is, decrease in tension of the print medium cannot be avoided with the control step during the initial printing period. Then, in the predictive control step, decrease in tension due to expansion of the print medium during the initial printing period is predicted, and the rotation speeds of the drive rollers downstream of the print unit is increased to suppress decrease in tension of the print medium. This achieves maintained printing quality from when printing starts until the print medium is brought into the steady state.

It is preferable that the predictive control step in the example of this invention includes predicting decrease in tension of the print medium in accordance with an area of patterns to be printed on the print medium. Expansion of the print medium due to adhesion of ink varies in accordance with an area of patterns, i.e., an area to which the ink adheres. Consequently, accurate prediction of the decrease in tension of the print medium can be achieved with use of the area of patterns to be printed on the print medium. Therefore, the decrease in tension of the print medium can be suppressed accurately.

It is preferable that the predictive control step in the example of this invention includes predicting decrease in tension of the print medium in accordance with a distance between a position of starting printing on the print medium and the drive roller disposed in an outlet side of the transportation path. Expansion of the print medium due to ink adhesion varies in accordance with the distance between the position of starting printing on the print medium and the drive roller disposed on the outlet side of the transportation path. Consequently, accurate prediction of the decreased tension of the print medium can be achieved with use of the distance between the position of starting printing on the print medium and the drive roller disposed on the outlet side of the transportation path. Therefore, decrease in tension of the print medium can be suppressed accurately.

It is preferable that both the control step and the predicting control step include controlling the rotation speeds of the drive rollers by adjusting a draw ratio between the two adjacent drive rollers or by adjusting a number of pulses applied to the drive rollers. Any approach as above enables to control the rotation speeds of the drive rollers appropriately.

Another example of this invention discloses an inkjet printing apparatus with a print-medium supply section feeding out a print medium wound in a roll form, two or more drive rollers disposed along a transportation path of the print medium, an inkjet print unit above the transportation path, a drying section disposed downstream of the print unit, and a print-medium collecting section winding up and collecting the dried print medium in a roll form. The inkjet printing apparatus includes a tension-generating device configured to generating tension of the print medium by a difference in speed between the two adjacent drive rollers; a tension-detecting device configured to detect tension acting on the print medium between the two adjacent drive rollers; a tension control device configured to control rotation speeds of the drive rollers such that a detected value of tension detected by the tension-detecting device has a target value of tension; and a predictive control device configured to predict decrease in tension due to expansion of the print medium during an initial period of starting printing on the print medium until the control device stabilizes the detected value of tension of the print medium, and to increase the rotation speeds of the drive rollers disposed downstream of the print unit to suppress decrease in tension of the print medium.

With the example of the invention, the print medium fed out from the print-medium supply section is transported with the two or more drive rollers disposed along the transportation path of the print medium. The print medium is printed by the print unit above the transportation path. The printed print medium is dried by the drying section. Thereafter, the print medium is wound up and collected by the print-medium collecting section. The tension-generating device generates tension on the print medium by the difference in speed between the two adjacent drive rollers. The tension-detecting device detects tension of the print medium between the two adjacent drive rollers. The tension control device controls the rotation speeds of the drive rollers such that the detected value of tension has the target value of tension. The operations above enable the tension control device to maintain the tension of the print medium at the target value of tension although the print medium expands in the steady state due to the ink adhering to the print medium. On the other hand, a certain time (a delay time) is needed during the initial period of starting printing to the print medium until the tension control device stabilizes the detected value of tension. That is, the tension control device cannot avoid decrease in tension of the print medium during the initial printing period. Then, the predictive control device predicts the decrease in tension due to expansion of the print medium during the initial printing period, and increases the rotation speeds of the drive rollers downstream of the print unit, thereby suppressing decrease in tension of the print medium. This achieves maintained printing quality from when printing starts until the print medium is brought into the steady state.

In the examples of this invention, the decrease in tension of the print medium due to ink adhesion to the print medium is predicted during the initial period of starting printing to the print medium, and the rotation speeds of the drive rollers disposed downstream of the print unit is increased. Accordingly, decrease in tension of the print medium can be suppressed. Therefore, the examples of this invention enable to maintain printing quality not only in the steady state but also during the initial printing period from starting printing until reaching the steady state.

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
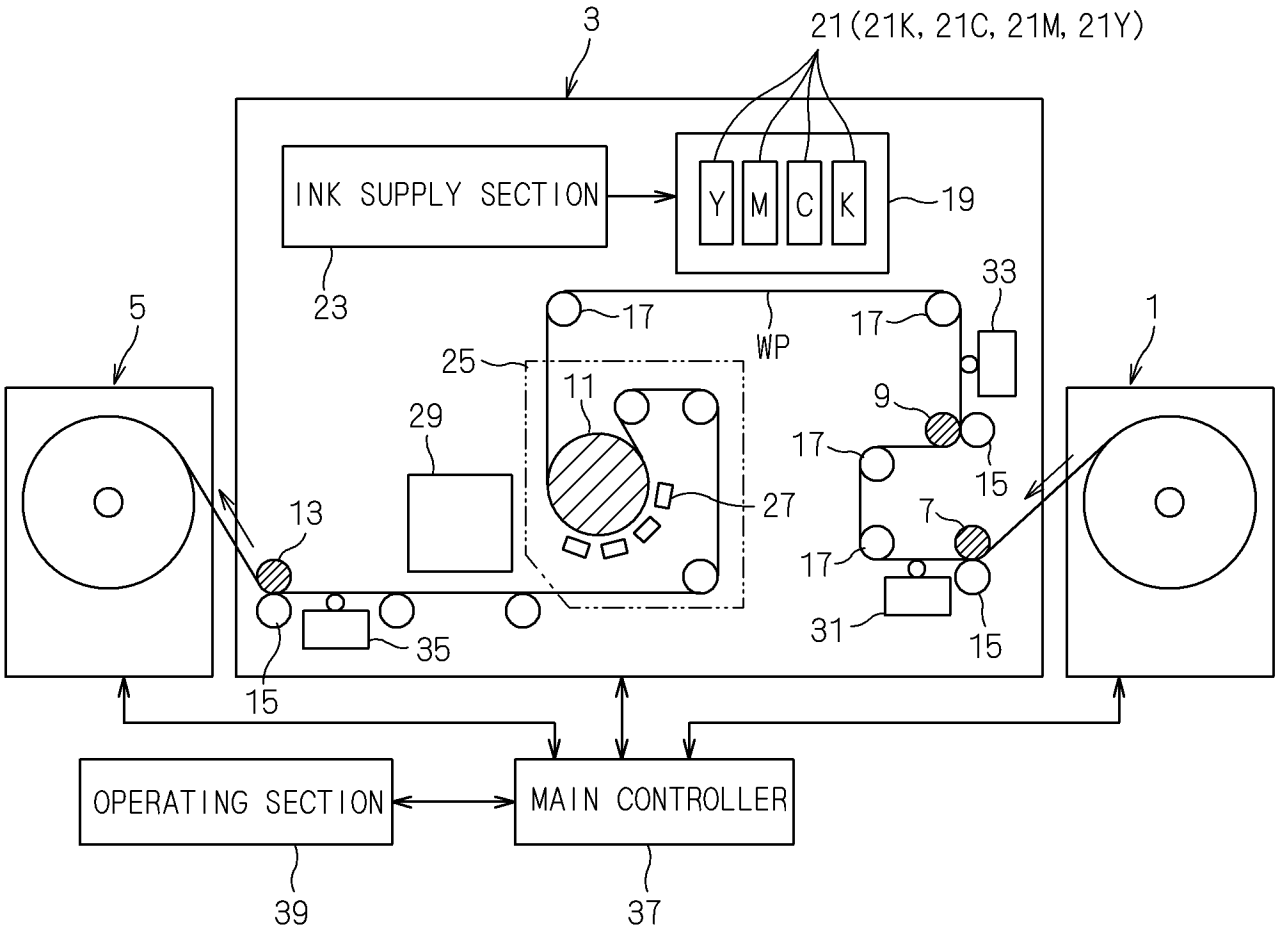
FIG. 1 is a schematic view illustrating an entire inkjet printing apparatus according to one example of this invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

Preferred examples of this invention will be described in detail hereinafter with reference to the drawings.

Example 1

FIG. 1 is a schematic view illustrating an entire inkjet printing apparatus according to one example of this invention.

The inkjet printing apparatus according to Example 1 includes a paper feeder 1, an inkjet printing apparatus body 3, and a take-up roller 5. The paper feeder 1 feeds out and supplies web paper WP wound in a roll form as a print medium, for example. The inkjet printing apparatus body 3 performs printing on the web paper WP fed thereto. The take-up roller 5 winds up and collect the printed web paper WP in a roll form. The paper feeder 1 corresponds to the print-medium supply section in this invention. The take-up roller 5 corresponds to the print-medium collecting section in this invention.

The paper feeder 1 holds the web paper WP in a roll form to be rotatable about a horizontal axis. The paper feeder 1 unwinds the web paper WP to feed the paper to the inkjet printing apparatus body 3. The take-up roller 5 winds up the web paper WP printed by the inkjet printing apparatus body 3 about a horizontal axis. Regarding the side from which the web paper WP is fed as upstream and the side to which the web paper WP is discharged as downstream, the paper feeder 1 is disposed upstream of the inkjet printing apparatus body 3, whereas the take-up roller 5 is disposed downstream of the inkjet printing apparatus body 3.

The printing apparatus body 3 includes two or more drive rollers 7, 9, 11, and 13 in this order from the upstream along the transportation path. The drive roller transports by roll the web paper WP fed out from the paper feeder 1 toward the take-up roller 5. Each of the drive rollers 7, 9, and 13 cooperates with a pressure roller 15 to sandwich the web paper WP. The drive roller 11 is a heating roller for drying ink printed on the web paper WP. Hereinafter, the "driving roller 11" is also referred to as the "heating roller 11." The heating roller 11 adopts no pressure roller in order to prevent ink adhesion to the pressure roller. The transportation path includes two or more guide rollers 17, besides the drive rollers 7, 9, 11, and 13. The guide roller guides the web paper WP.

An inkjet printing unit 19 is disposed downstream of the second drive roller 9 from upstream. The print unit 19 includes ink discharging heads 21 for discharging ink droplets. Two or more ink discharging heads 21 are arranged along a transport direction of the web paper WP. For instance, four ink discharging heads 21K, 21C, 21M and 21Y for black (K), cyan (C), magenta (M), and yellow (Y), respectively, are provided separately in this order from upstream. The ink discharging heads 21K, 21C, 21M and 21Y are arranged also in a horizontal direction (width direction) perpendicular to the transport direction of the web paper WP. That is, two or more ink discharging heads 21K, 21C, 21M and 21Y are disposed also in the width direction of the web paper WP. The ink discharging heads are enough to perform printing without moving over a printing area in the width direction of the web paper WP. As noted above, the inkjet printing apparatus body 3 in Example 1 performs printing on the web paper WP while transporting the web paper WP with the ink discharging heads 21K, 21C, 21M and 21Y not moving in the horizontal direction perpendicular to the transport direction of the web paper WP for primary scanning but remaining stationary. This mode is called one-pass mode. Ink is supplied from an ink supply section 23 to each of the ink discharging heads 21.

A drying section 25 is disposed downstream of the print unit 19. The drying section 25 includes the heating roller 11 mentioned above. The heating roller 11 contains an infrared lamp, not shown. A warm-air blowing section 27 is disposed along a circumferential surface of the heating roller 11. The warm-air blowing section 27 blows warm air towards the circumferential surface of the heating roller 11.

An inspecting unit 29 is disposed downstream of the drying section 25. The inspecting unit 29 inspects the printed portions for any stains or omissions. The take-up roller 5 winds up and collects the inspected web paper WP fed out downstream by the drive roller 13.

Moreover, the printing apparatus body 3 includes two or more tension sensors 31, 33, and 35 disposed along the transportation path for detecting tension acting on the web paper WP. The tension sensor 31 detects tension acting on the web paper WP between the two adjacent drive rollers 7 and 9. The tension sensor 33 detects tension acting on the web paper WP between the two adjacent drive roller 9 and heating roller 11. The tension sensor 35 detects tension acting on the web paper WP between the two adjacent heating roller 11 and drive roller 13. Here, the tension sensors 31, 33, and 35 correspond to the tension detection device in this invention.

The inkjet printing apparatus according to Example 1 further includes a main controller 37 and an operating section 39. The main controller 37 controls en bloc each element of the inkjet printing apparatus. The main controller 37 is formed of a central processing unit (CPU) and others. The operating section 39 operates the inkjet printing apparatus. The operating section 39 is formed of a touch panel, various switches and others. The operating section 39 sets a reference speed of a motor M2, draw ratios of motors M1, M3, and M4, a target value of tension between the two adjacent drive rollers, increased rates of speeds of the motors M3 and M4 for predictive control, and others. These motors are to be mentioned later. As is apparent from the descriptions below, the main controller 37 has functions as the tension-generating device, the tension-control device, and the predictive control device in this invention.

Figure 2:
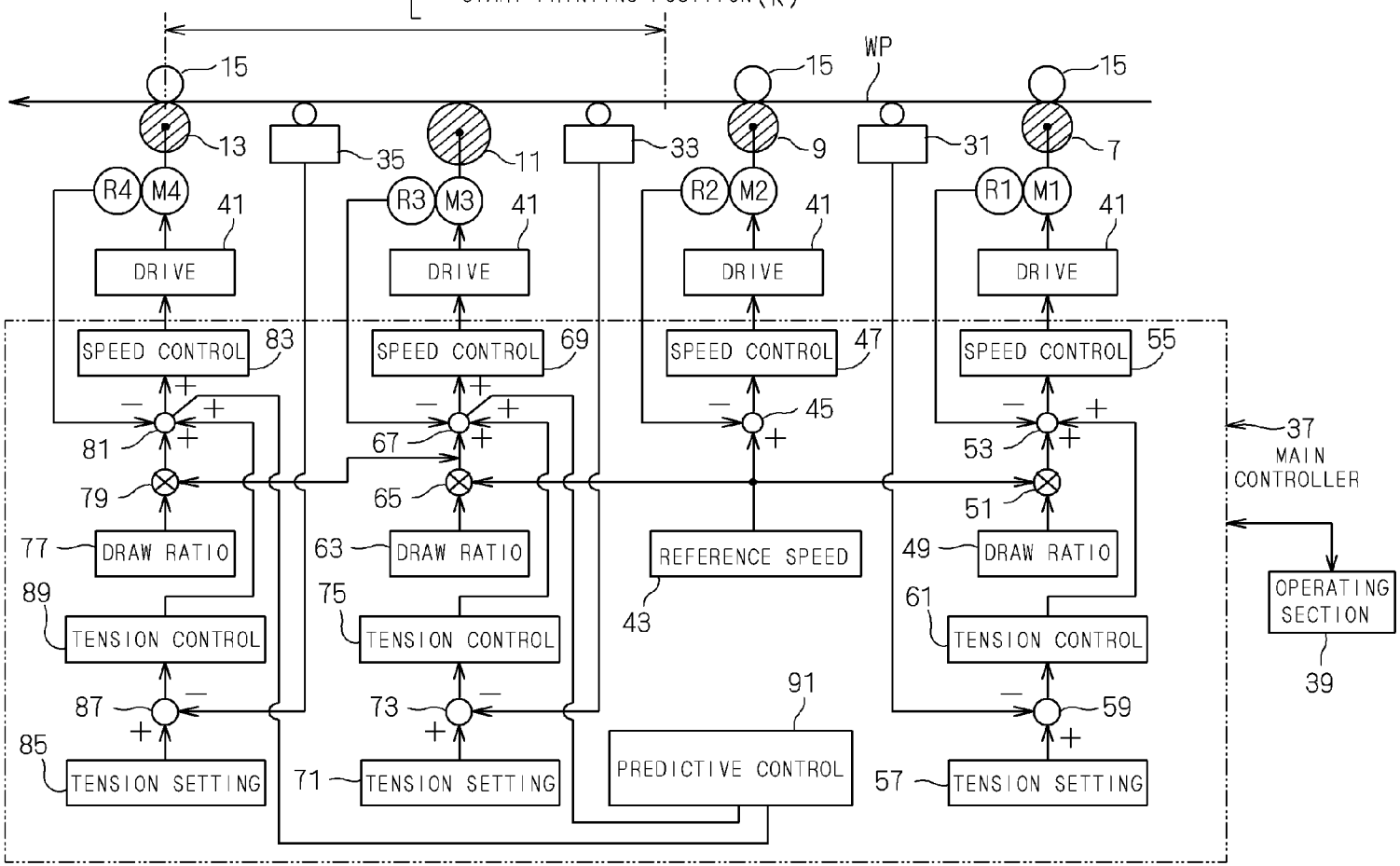
FIG. 2 is a block diagram illustrating control of the inkjet printing apparatus according to the example of this invention.

Description will be given next of a transportation control system of the inkjet printing apparatus according to Example 1 with reference to FIG. 2. FIG. 2 is a block diagram illustrating a transportation control system of the inkjet printing apparatus according to Example 1.

The components in FIG. 2 has the same components as in FIG. 1 that are denoted by the same symbols as in FIG. 1. The drive rollers 7, 9, 11, and 13 are driven by the motors M1, M2, M3, and M4, respectively. The motors M1 to M4 are each connected to a drive circuit 41. The motors M1 to M4 have rotation detecting sensors R1 to R4, respectively, attached thereto for detecting each rotation speed thereof. The motor M2 is used as reference for transporting the web paper WP at a given reference speed. The main controller 37 as a control system for driving the motor M2 at a reference speed includes a reference-speed setting section 43, a subtraction operator 45, and a speed controller 47. The reference-speed setting section 43 sets a reference speed. The subtraction operator 45 calculates a deviation between the reference speed value and the detected speed value of the motor M2. The speed controller 47 controls the rotation speed of the motor 2 so as to eliminate the deviation. For instance, the speed control section 47 adopts PID control. Here, not the first motor M1 but the second motor M2 of the drive system is adopted as reference. This is because the speed of feeding out the web paper WP from the paper feeder 1 greatly varies, and thus influences due to this should be avoided.

The main controller 37 includes the following control system as a device for generating tension on the web paper WP (a tension-generating device) by driving the motor M1 at a given rotation-speed ratio (draw ratio) relative to the motor M2 to generate a difference in speed between the two adjacent drive rollers 7 and 9. Specifically, the control system is provided with a draw-ratio setting section 49, a multiplication operator 51, a subtraction operator 53, and a speed controller 55. The draw-ratio setting section 49 sets a rotation-speed ratio (draw ratio) of the motor M1 relative to the motor M2. The multiplication operator 51 outputs commands on rotation speeds by multiplying the draw ratio by a reference speed. The subtraction operator 53 calculates a deviation among the commands on the rotation speeds, the detected speed value of the motor M1 and a correction speed value, to be mentioned later. The speed controller 55 controls the rotation speed of the motor M1 so as to eliminate the deviation.

The main controller 37 further includes the following control system as a device (a tension controller) for maintaining the tension acting on the web paper WP between the two adjacent drive rollers 7 and 9 at a given value. Specifically, the control system is provided with a tension-setting section 57, a subtraction operator 59, and a tension controller 61. The tension-setting section 57 sets a target value of tension acting on the web paper WP. The subtraction operator 59 calculates a deviation between the target value of tension and a detected value of tension from the tension sensor 31. The tension controller 61 calculates a correction speed value of the motor M1 to eliminate the deviation to apply the correction speed value to the subtraction operator 53. For instance, the tension control section 61 adopts PI (proportionality and integration) control.

Similarly, the main controller 37 includes a draw-ratio setting section 63, a multiplication operator 65, a subtraction operator 67, and a speed controller 69. These elements are provided as a device (a tension-generating device) for generating tension on the web paper WP by driving the motor M3 at a given rotation-speed ratio (draw ratio) relative to the motor M2 to generate a difference in speed between the two adjacent drive rollers 9 and 11. The main controller 37 further includes a tension-setting section 71, a subtraction operator 73, and a tension controller 75. These elements are provided as a device (a tension controller) for maintaining the tension acting on the web paper WP between the two adjacent drive rollers 9 and 11 at a given value.

Similarly, the main controller 37 includes a draw-ratio setting section 77, a multiplication operator 79, a subtraction operator 81, and a speed controller 83. These elements are provided as a device for generating tension on the web paper WP (a tension-generating device) by driving the motor M4 at a given rotation-speed ratio (draw ratio) relative to the motor M3 to generate a difference in speed between the two adjacent drive rollers 11 and 13.

The main controller 37 further includes a tension-setting section 85, a subtraction operator 87, and a tension controller 89. These elements are provided as a device (a tension controller) for maintaining the tension acting on the web paper WP between the two adjacent drive rollers 11 and 13 at a given value. The main controller 37 further includes a predictive controller 91. The predictive controller 91 predicts decrease in tension due to expansion of the web paper WP during an initial period of starting printing to the web paper WP until the tension control system mentioned above stabilizes the detected value of tension of the web paper WP, and then increases the rotation speeds of the two adjacent drive rollers 11 and 13 disposed downstream of the print unit 19 to suppress decrease in tension of the web paper WP. Here, the predictive control section 91 corresponds to the predictive controller in this invention. Description will be given later of a specific control mode of the predictive controller 91.

Figures 3A, 3B:
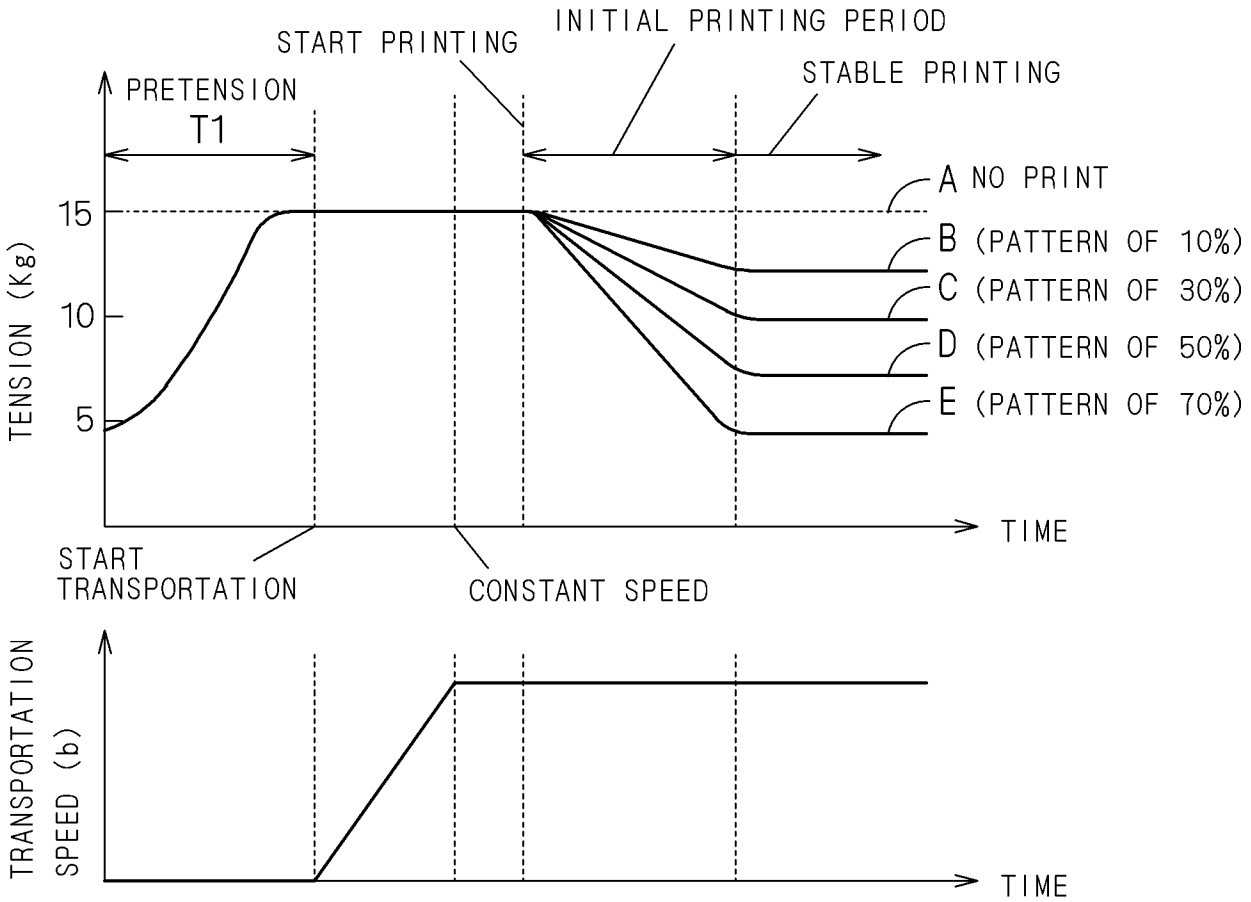
FIG. 3A is a schematic view illustrating variations in tension of web paper when rotation speeds of motors are controlled only through draw control.
FIG. 3B illustrates variations in transportation speed of the web paper.
Figure 4:
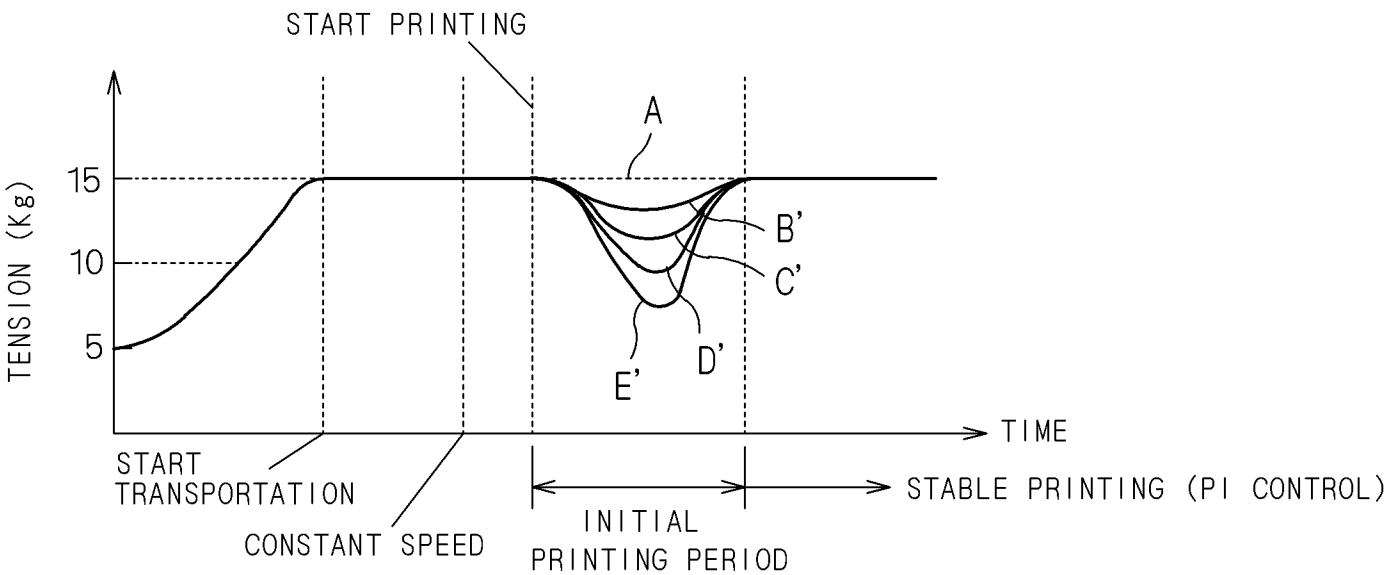
FIG. 4 is a schematic view illustrating variations in tension of the web paper when the rotation speeds of the motors are controlled through the draw control and tension control.

Description will be given next of a method of controlling transportation of the web paper WP in the inkjet printing apparatus according to Example 1 with reference to FIGS. 3 to 5.

In order to facilitate understanding of the invention, description will be given first of variations in tension acting on the web paper WP when the rotation speeds of the motors M1 to M4 are controlled only with the draw ratios while no tension on the web paper WP is controlled (i.e., draw control). FIG. 3A is a schematic view illustrating time-series variations in tension acting on the web paper WP through the draw control only. FIG. 3B illustrates time-series variations in transportation speed of the web paper WP through the draw control only.

(1) Pretension Period: T1

In order to apply given tension to the web paper WP simultaneously with transportation of the web paper WP, tension is gradually applied to the web paper WP prior to transporting the web paper WP. Specifically, the motor M1 stops while the motor M2 drives, whereby tension can be applied to the web paper WP with the web paper WP not being transported between the two adjacent drive rollers 7 and 9.

(2) Start Transportation

When given tension acts on the web paper WP, transportation of the web paper WP starts. Specifically, the speed of the motor M2 used as reference is controlled to be a reference speed value. Each speed of the other motors M1, M3, and M4 is controlled to be a target speed value in accordance with the draw ratios set individually.

(3) Start Printing

When the web paper WP is transported at a given speed, printing starts.

(4) Initial Printing Period

When printing starts and ink adheres to the web paper WP, the web paper WP expands due to the ink penetrated in the paper, resulting in decreased tension of the web paper WP. Where no tension control is performed, tension of the web paper WP decreases as printing proceeds during an initial printing period, i.e., as a region of the web paper WP spreads where the ink adheres.

(5) Printing Stabilizing Period

When a portion of the web paper WP where printing starts is dried and reaches the drive roller 13 on the outlet side of the transportation path, a region of ink adhesion becomes approximately uniform in time sequence, resulting in appropriately uniform expansion of the web paper WP. As a result, tension of the web paper WP has an appropriately even value and is stable although the tension is lower than a targeted value (in this example, 15 kg). The tension of the web paper WP decreases greatly as an area of ink adhesion increases. The area of ink adhesion varies in accordance with a pattern area to be printed. That is, the tension of the web paper WP decreases greatly as the pattern area becomes large. In FIG. 3A, a case where no printing is performed (no ink adheres) is denoted by the symbol A. In this case, no tension on the web paper WP varies. Moreover, variations in tension are denoted by the symbols B, C, D, and E where rates of the pattern area are 10%, 30%, 50%, and 70%, respectively. The variations prove that the tension greatly decreases as the pattern area becomes large.

The tension of the web paper WP varies in accordance with a distance between the position of starting printing on the web paper (in this example, a position where the most-upstream inkjet head 21K is disposed) and the drive roller 13 disposed on the outlet side of the transportation path (denoted by the symbol L in FIG. 2). Specifically, a decrease width of tension becomes large as the distance L becomes long. However, since the distance L is a unique value for the printing apparatus, the distance does not vary in accordance with printing contents, such as the pattern area.

Description will be given next of controlling the tension of the web paper WP in addition to the draw control mentioned above.

The tension sensors 31, 33, and 35 are disposed between the two adjacent drive rollers 7 and 9, between the two adjacent drive rollers 9 and 11, and between the two adjacent drive rollers 11 and 13, respectively. The tension sensors 31, 33, and 35 detect tension of the web paper WP between the two adjacent rollers, and the tension is fed back to tension-control systems of the motors M1, M3, and M4, respectively. Then the detected values of tension are each compared with the target value of tension set in each of tension-setting sections 57, 71, and 85. Thereafter, the deviations are applied to the tension controllers 61, 75, and 89, respectively. The tension controllers 61, 75, and 89 adjust speed commands by applying each speed correction value to each of the subtraction operators 53, 67, and 81 of the speed control systems, thereby eliminating the deviations. As a result, as illustrated in FIG. 4, the tension of the web paper WP decreasing with starting printing is controlled so as to be approximately the target value of tension at the end of the initial printing period (for example, when the portion of the web paper WP where printing starts reaches the drive roller 13 on the outlet side of the transportation path).

The tension acting on the web paper WP is maintained appropriately after the initial printing period elapses. As is apparent from FIG. 4, however, the tension of the web paper WP is lower than the target value of tension during the initial printing period until the tension control systems are stable. The symbols B', C', D', and E' in FIG. 4, corresponding to the symbols B, C, D, and E in FIG. 3, respectively, illustrate decrease in tension. Leaving the decrease in tension causes decrease in tension during the initial printing period, resulting in reduced printing quality occurring from so-called shift register during the initial printing period. Accordingly, in the inkjet printing apparatus according to Example 1, the predictive controller 91 functions during the initial printing period to suppress decrease in tension of the web paper WP.

Description will be given hereinafter of the predictive control of the tension on the web paper with reference to FIG. 5.

Figures 5A, 5B:
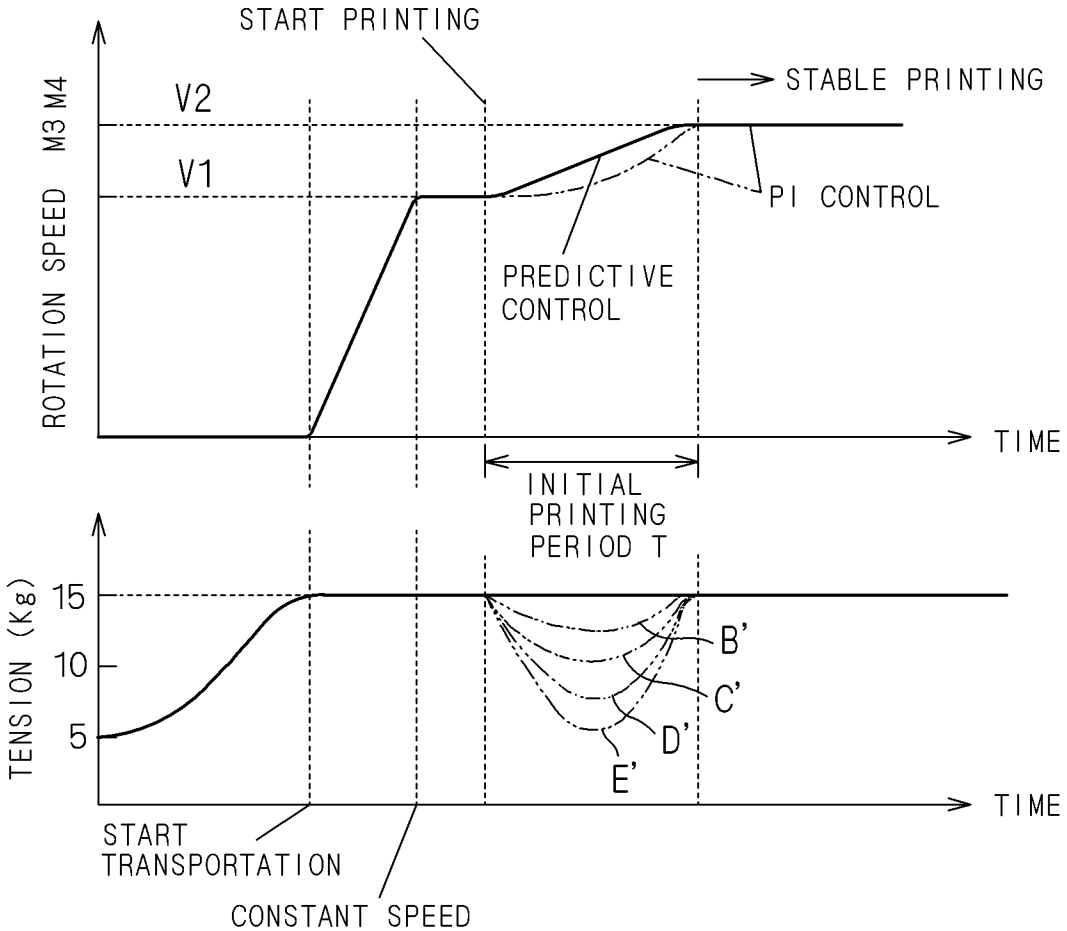
FIG. 5A is a schematic view illustrating variations in rotation speed of the motors when the rotational speeds are controlled through predictive control during the initial printing period.
FIG. 5B is a schematic view illustrating variations in tension of the web paper in the predictive control.

FIG. 5A illustrates variations in rotation speed of the motors M3 and M4 when predictive control is performed to the tension during the initial printing period. FIG. 5B illustrates variations in tension on the web paper WP in the predictive control. Decrease in tension of the web paper WP due to adhesion of the ink droplets occurs after printing. Accordingly, the rotation speeds of the two adjacent drive rollers 11 and 13 downstream of the print unit 19 are adjusted through the predictive control.

Where the tension of the web paper WP is adjusted through tension control (PI control), the rotation speeds of the motors M3 and M4 vary as dashed lines in FIG. 5A during the initial printing period (a period T in FIG. 5) due to delay in control. As a result, the tension of the web paper WP decreases temporarily, as illustrated by dashed lines B', C', and D' in FIG. 5B, in accordance with the pattern area. Accordingly, the predictive controller 91 increases the rotation speeds of the motors M3 and M4 from V1 to V2 approximately proportionally during the initial printing period T, as illustrated by solid lines in FIG. 5A.

Specifically, the prediction correction value (the number of pulses) for increasing the rotation speed is added to the subtraction operators 67 and 81 in the speed control systems of the motors M3 and M4. Here, the rotation speed V1 is a rotational speed upon starting printing, whereas V2 is a rotation speed after tension control is stabilized. The rotation speed V2 varies in accordance with the pattern area. The increased rate of the rotation speed of V1 to V2 is determined in advance through experiments. The determined increased rate of speed is set by the operating section 39 into the predictive controller 91. Of course, such the increased rate is set for each of the motors M3 and M4. The mode of variations in rotation speed during the initial printing period is also determined through experiments. Thus, the rotation speed does not always vary in proportion to time. Moreover, it is complicated to set the increased rate of speed for every pattern area. Consequently, the increased rate of speed for a typical pattern area may be used uniformly.

After the initial printing period elapses, the predictive control is completed and only normal tension control (PI control) is performed. At the end of the initial printing period, the sensor attached to the drive roller 13 on the outlet side of the transportation path may detect passing of the web paper WP. Alternatively, a given period of time after starting printing may be determined as the initial printing period in accordance with the transportation speed of the web paper WP.

As noted above, with the inkjet printing apparatus according to Example 1, decrease in tension due to expansion of the web paper WP by ink adhesion is predicted during the initial period of starting printing until the tension control is stabilized. Then the rotation speeds of the two adjacent drive rollers 11 and 13 disposed downstream of the print unit 19 increase to suppress the decrease in tension. Consequently, the tension of the web paper WP can be maintained properly even during the initial printing period, resulting in elimination of reduction in printing quality during the initial printing period.

Example 2

Figure 6:
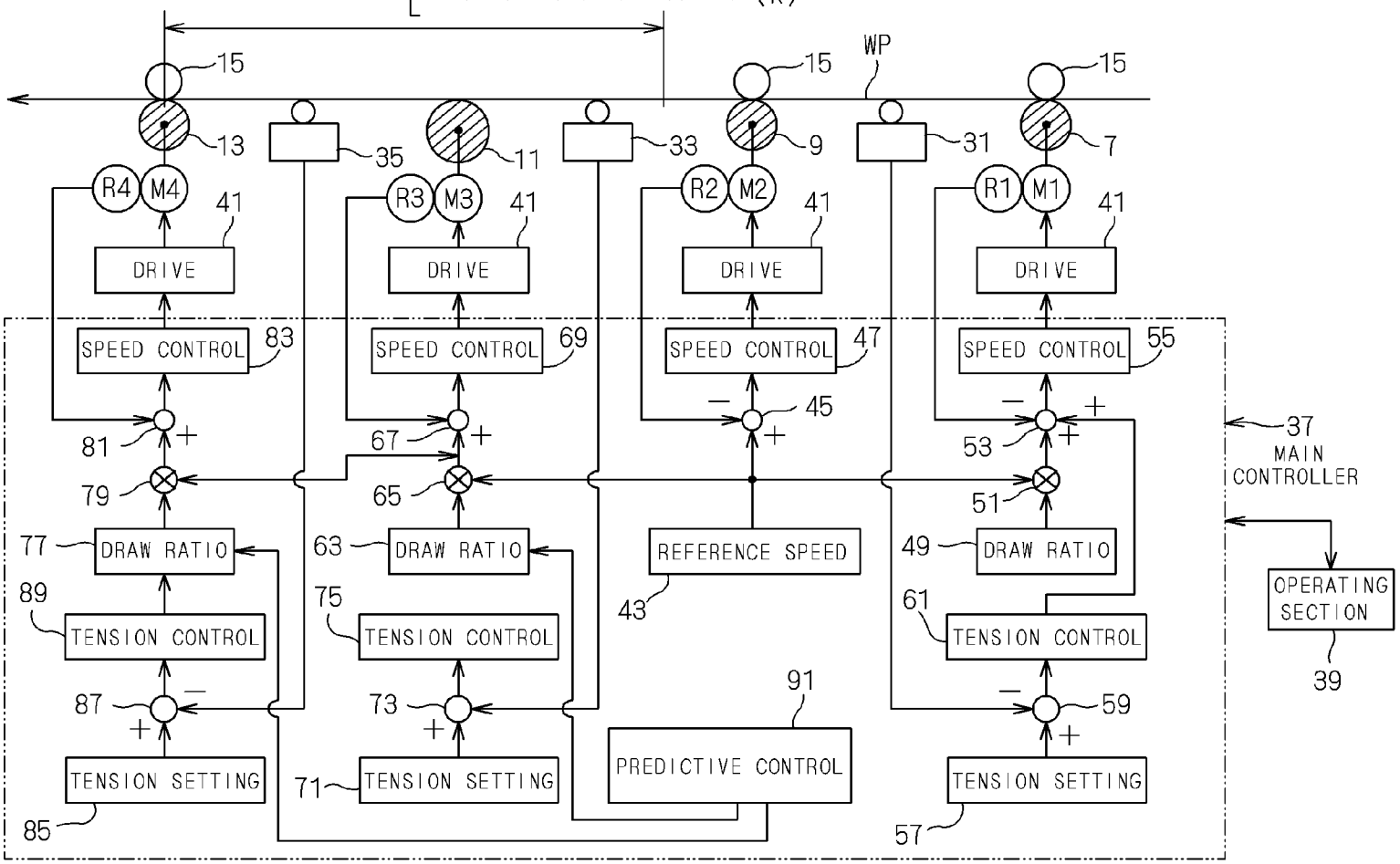
FIG. 6 is a block diagram illustrating control of an inkjet printing apparatus according to another example of this invention.

Description will be given of Example 2 with reference to FIG. 6. FIG. 6 is a block diagram illustrating a transport control system of an inkjet printing apparatus according to Example 2. The overall configuration of the inkjet printing apparatus in Example 2 is same as that in Example 1 illustrated in FIG. 1, and therefore the description thereof is not to be omitted.

In Example 1, tension control and predictive control of tension is performed by adjusting the speed commands applied to the speed control systems of the drive motors M1, M3, and M4. In contrast to this, in Example 2, tension control and predictive control of tension is performed by adjusting the draw ratios of the drive motors M1, M3, and M4. That is, each draw ratio of the drive motors M1, M3, and M4 set by the draw-ratio setting sections 49, 63, and 77, respectively, varies in accordance with calculation output from the tension controller 61, 75, and 89. Consequently, the tension on the web paper WP between the drive motors 7 and 9, between the drive motors 9 and 11, and between the drive motors 11 and 13 can be maintained at the target value of tension.

Figure 7:
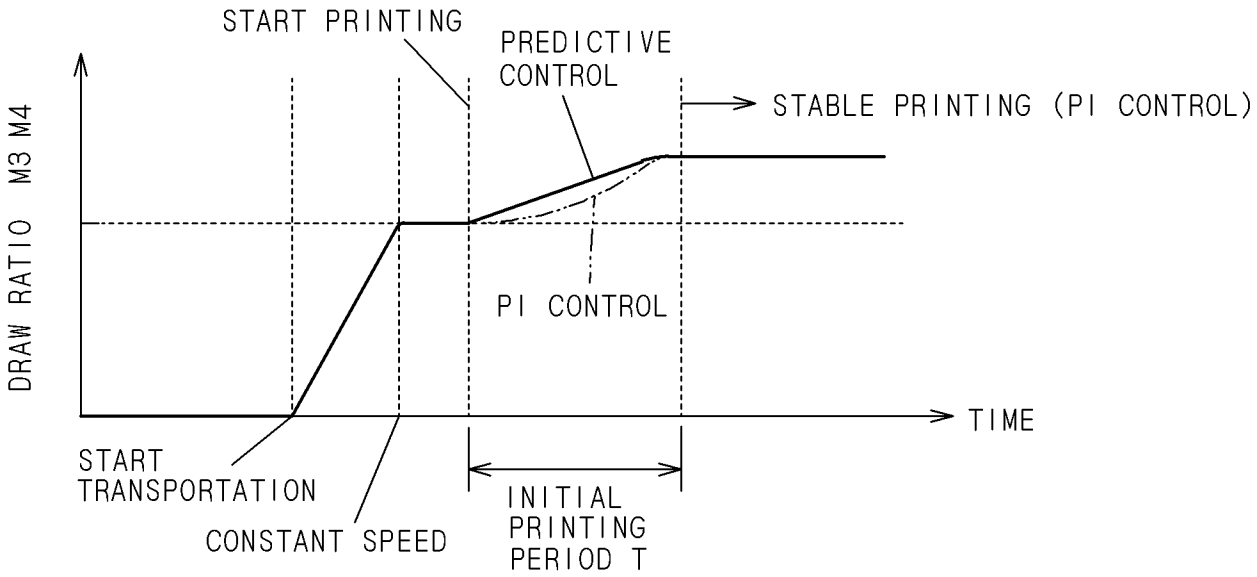
FIG. 7 is a schematic view illustrating variations in draw ratio of motors according to the other example of the invention.

In the initial printing period, the predictive controller 91 predicts decrease in tension of the web paper WP due to expansion of the web paper WP by ink adhesion. Then the predictive controller 91 varies the draw ratios of the two adjacent drive rollers 11 and 13 disposed downstream of the print unit 19 to suppress the decrease in tension. Similar to Example 1, the draw ratios of the motors M3 and M4 vary depending on experiments. FIG. 7 is a schematic view illustrating variations in draw ratio of the motors M3 and M4. In this example, the rotation speed of the motors M3 and M4 increase by increasing the draw ratios during the initial printing period in proportion to time. Similarly to Example 1, predictive control is performed to each of the draw ratios of the motors M3 and M4 individually. The predictive control as above causes increased rotation speed of the two adjacent drive rollers 11 and 13. Thus, the tension on the web paper WP can be maintained properly even during the initial printing period, resulting in elimination of reduction in printing quality during the initial printing period.

This invention is not limited to the foregoing examples, but may be modified as follows.

(1) Each of the foregoing Examples 1 and 2 adopts four drive rollers for transporting the web paper WP as one example. The number of drive rollers other than four is applicable to this invention.

(2) In each of the foregoing Examples 1 and 2, the speed of the second drive roller is adopted as a reference speed, and the speeds of the other drive rollers are controlled based on the reference speed. Alternatively, any drive roller may be adopted as reference optionally.

(3) In each of the foregoing Examples 1 and 2, the inkjet printing apparatus of one-pass mode has been described by way of example. This invention is not limited to such a mode, but is applicable also to the inkjet printing apparatus of multi-pass mode.

This invention may be embodied in other specific forms without departing from the spirit or essential attributes thereof and, accordingly, reference should be made to the appended claims, rather than to the foregoing specification, as indicating the scope of the invention.

What is claimed is:

1. A method for transporting a print medium in an inkjet printing apparatus in which the print medium wound in a roll form is fed out, the print medium is transported by roll with two or more drive rollers disposed along a transportation path of the print medium, the print medium is printed with an inkjet print unit disposed above the transportation path, ink adhering to the print medium is dried by a drying section disposed downstream of the print unit, and the print medium is finally wounded and collected in a roll form, the method comprising:

a tension-generating step of generating tension on the print medium in accordance with a difference in speed between the two adjacent drive rollers;

a tension-detecting step of detecting tension acting on the print medium between the two adjacent drive rollers;

a controlling step of controlling rotation speeds of the drive rollers such that the detected value of tension has a target value of tension; and a predictive control step of predicting decrease in tension due to expansion of the print medium during an initial period of starting printing on the print medium until the control step causes the stable detected value of tension, and increasing the rotation speeds of the drive rollers downstream of the print unit to suppress decrease in tension of the print medium.

2. The method for transporting the print medium in the inkjet printing apparatus according to claim 1, wherein the predictive control step includes predicting decrease in tension of the print medium in accordance with an area of patterns to be printed on the print medium.

3. The method for transporting the print medium in the inkjet printing apparatus according to claim 1, wherein the predictive control step includes predicting decrease in tension of the print medium in accordance with a distance between a position of starting printing on the print medium and the drive roller disposed in an outlet side of the transportation path.

4. The method for transporting the print medium in the inkjet printing apparatus according to claim 1, wherein both the control step and the predicting control step include controlling the rotation speeds of the drive rollers by adjusting a draw ratio between the two adjacent drive rollers.

5. The method for transporting the print medium in the inkjet printing apparatus according to claim 2, wherein both the control step and the predicting control step include controlling the rotation speeds of the drive rollers by adjusting a draw ratio between the two adjacent drive rollers.

6. The method for transporting the print medium in the inkjet printing apparatus according to claim 3, wherein both the control step and the predicting control step include controlling the rotation speeds of the drive rollers by adjusting a draw ratio between the two adjacent drive rollers.

7. The method for transporting the print medium in the inkjet printing apparatus according to claim 1, wherein both the control step and the predicting control step include controlling the rotation speeds of the drive rollers by adjusting a number of pulses applied to the drive rollers.

8. The method for transporting the print medium in the inkjet printing apparatus according to claim 2, wherein both the control step and the predicting control step include controlling the rotation speeds of the drive rollers by adjusting a number of pulses applied to the drive rollers.

9. The method for transporting the print medium in the inkjet printing apparatus according to claim 3, wherein both the control step and the predicting control step include controlling the rotation speeds of the drive rollers by adjusting a number of pulses applied to the drive rollers.

10. An inkjet printing apparatus with a print-medium supply section feeding out a print medium wound in a roll form, two or more drive rollers disposed along a transportation path of the print medium, an inkjet print unit above the transportation path, a drying section disposed downstream of the print unit, and a print-medium collecting section winding up and collecting the dried print medium in a roll form, the inkjet printing apparatus comprising:

a tension-generating device configured to generate tension of the print medium by a difference in speed between the two adjacent drive rollers;

a tension-detecting device configured to detect tension acting on the print medium between the two adjacent drive rollers;

a tension control device configured to control rotation speeds of the drive rollers such that a detected value of tension detected by the tension-detecting device has a target value of tension; and a predictive control device configured to predict decrease in tension due to expansion of the print medium during an initial period of starting printing on the print medium until the control device stabilizes the detected value of tension of the print medium, and to increase the rotation speeds of the drive rollers disposed downstream of the print unit to suppress decrease in tension of the print medium.

11. The inkjet printing apparatus according to claim 10, wherein the predictive control device predicts decrease in tension of the print medium in accordance with an area of patterns to be printed on the print medium.

12. The inkjet printing apparatus according to claim 10, wherein the predictive control device predicts decrease in tension of the print medium in accordance with a distance between a position of starting printing on the print medium and the drive roller disposed in an outlet side of the transportation path.

13. The inkjet printing apparatus according to claim 10, wherein both the tension control device and the predicting control device control the rotation speeds of the drive rollers by adjusting a draw ratio between the two adjacent drive rollers.

14. The inkjet printing apparatus according to claim 11, wherein both the tension control device and the predicting control device control the rotation speeds of the drive rollers by adjusting a draw ratio between the two adjacent drive rollers.

15. The inkjet printing apparatus according to claim 12, wherein both the tension control device and the predicting control device control the rotation speeds of the drive rollers by adjusting a draw ratio between the two adjacent drive rollers.

16. The inkjet printing apparatus according to claim 10, wherein both the tension control device and the predicting control device control the rotation speeds of the drive rollers by adjusting a number of pulses applied to the drive rollers.

17. The inkjet printing apparatus according to claim 11, wherein both the tension control device and the predicting control device control the rotation speeds of the drive rollers by adjusting a number of pulses applied to the drive rollers.

18. The inkjet printing apparatus according to claim 12, wherein both the tension control device and the predicting control device control the rotation speeds of the drive rollers by adjusting a number of pulses applied to the drive rollers.

* * * * *